US008888935B2

(12) United States Patent
Grix et al.

(10) Patent No.: US 8,888,935 B2
(45) Date of Patent: Nov. 18, 2014

(54) FAMILY OF MODIFIABLE HIGH PERFORMANCE ELECTRICALLY CONTROLLED PROPELLANTS AND EXPLOSIVES

(75) Inventors: Charles E. Grix, Citrus Heights, CA (US); Wayne N. Sawka, Reno, CA (US)

(73) Assignee: Digital Solid State Propulsion, LLC, Reno, NV (US)

( * ) Notice: Subject to any disclaimer, the term of this patent is extended or adjusted under 35 U.S.C. 154(b) by 209 days.

(21) Appl. No.: 12/993,084

(22) PCT Filed: May 15, 2009

(86) PCT No.: PCT/US2009/044256

§ 371 (c)(1), (2), (4) Date: Nov. 16, 2010

(87) PCT Pub. No.: WO2010/039290

PCT Pub. Date: Apr. 8, 2010

(65) Prior Publication Data

US 2011/0067789 A1 Mar. 24, 2011

Related U.S. Application Data

(60) Provisional application No. 61/053,900, filed on May 16, 2008.

(51) Int. Cl.

| | |
|---|---|
| ***C06B 45/10*** | (2006.01) |
| ***C06B 31/28*** | (2006.01) |
| ***C06B 31/00*** | (2006.01) |
| ***C06B 23/00*** | (2006.01) |
| ***C06B 47/00*** | (2006.01) |

(52) U.S. Cl.

CPC ..... *C06B 47/00* (2013.01); *C06B 31/00* (2013.01); *C06B 23/007* (2013.01); *C06B 23/006* (2013.01); *C06B 23/001* (2013.01)

USPC ..... 149/19.1; 149/45

(58) Field of Classification Search

CPC ..... C06B 45/10; C06B 31/28; C06B 31/00; C06B 47/00; C06B 23/007; C06B 23/001; C06B 23/006

USPC ..... 149/19.1, 45, 46

See application file for complete search history.

(56) References Cited

U.S. PATENT DOCUMENTS

| | | | | |
|---|---|---|---|---|
| 3,697,340 | A * | 10/1972 | Swedenberg | 149/19.5 |
| 5,607,181 | A | 3/1997 | Richardson et al. | |
| 5,734,124 | A | 3/1998 | Bruenner et al. | |
| 5,847,315 | A * | 12/1998 | Katzakian et al. | 149/19.91 |

(Continued)

*Primary Examiner* — Aileen B Felton

(74) *Attorney, Agent, or Firm* — Temmerman Law Office; Mathew J. Temmerman

(57) ABSTRACT

A composition capable of producing either solid propellant grains, liquid or gel monopropellants, all of which are electrically ignitable and capable of sustained controllable combustion at ambient pressure. Additional compositions capable of sustained controllable combustion at elevated pressures are described. Applications for the compositions disclosed herein are provided, and include among other applications use in small micro thrusters, large core-burning solid propellant gains, shaped explosives charges for military application, and pumpable liquids and gel monopropellants or explosives for military, commercial mining or gas and oil recovery. In alternative embodiments the above compositions may also incorporate an energetic nitrate polymer, bum rate modifiers, and/or metal fuel(s). The HIPEP formulation makes it possible to ignite and sustain combustion at ambient and vacuum conditions (a) without continuous electrical power and (b) while providing faster bum rates.

48 Claims, 6 Drawing Sheets

(56) References Cited

U.S. PATENT DOCUMENTS

| | | | | |
|---|---|---|---|---|
| 5,959,242 | A | 9/1999 | Knowlton et al. | |
| 6,083,331 | A | 7/2000 | Taylor et al. | |
| 6,231,701 | B1 | 5/2001 | Blomquist | |
| 6,849,247 | B1 * | 2/2005 | Elstrodt et al. | 423/657 |
| 2006/0011276 | A1 | 1/2006 | Grix et al. | |

* cited by examiner

FAMILY OF MODIFIABLE HIGH PERFORMANCE ELECTRICALLY CONTROLLED PROPELLANTS AND EXPLOSIVES

RELATED APPLICATIONS

This application is a national phase of International Application No. PCT/US2009/044256, filed May 15, 2009, and published in English as WO 2010/039290on Apr. 8, 2010, which claims priority from U.S. provisional patent application Ser. No. 61/053,900, filed May 16, 2008, entitled "Family of Modifiable High Performance Electrically Ignitable Solid Propellants", which are hereby incorporated by reference herein in its entirety as if set out in full.

This application is further related to previously filed U.S. patent application Ser. No. 11/305,742, filed Dec. 16, 2005, entitled "Controllable Digital Solid State Cluster Thrusters for Rocket Propulsion and Gas Generation", to previously filed U.S. patent application Ser. No. 10/136,786, filed Apr. 24, 2003, entitled "Electrically Controlled Propellant Composition and Method", and to previously filed U.S. patent application Ser. No. 11/787,001, filed Apr. 13, 2007, entitled "High Performance Electrically Controlled Solution Solid Propellant", all of which are incorporated by reference herein in their entirety for all purposes. This application is further related to three U.S. provisional patent applications filed on May 16, 2008, entitled "Family of Metastable Intermolecular Composites Utilizing Energetic Liquid Oxidizers with Nano-Particle Fuels In Gel-Sol Polymer Network" (Ser. No. 61/053,916), "Electrode Ignition and Control of Electrically Ignitable Materials" (Ser. No. 61/053,971), and "Physical Destruction of Electrical Device and Method for Triggering Same" (Ser. No. 61/053,956), all of which are hereby incorporated by reference herein in their entirety as if set out in full.

This application is further related to two U.S. Patent applications and one PCT application filed on an even date herewith: "Family of Metastable Intermolecular Composites Utilizing Energetic Liquid Oxidizers with NanoParticle Fuels in Sol-Gel Polymer Network" filed as a U.S. Application (U.S. patent application Ser. No. 12/467,209,) "Electrode Ignition and Control of Electrically Ignitable Materials" filed as PCT Application No. PCT/US09/44206, and "Physical Destruction of Electrical Device and Methods for Triggering Same" filed as U.S. application Ser. No. 12/467,125.

STATEMENT REGARDING FEDERALLY SPONSORED RESEARCH OR DEVELOPMENT

Portions of the invention described herein were made in part with Government support under a Small Business Innovative Research Contract ("Miniaturized Safe-Fuel Electrically Controlled Divert & Attitude Control System," Contract No. N65538-07-M-0119) awarded by the United States Navy and a subcontract under the Office of Naval Research, DE Technologies Inc. ("Tactical Urban Strike Weapon: Safe Fire-From-Enclosure the Marine Alternative to Double-base Propellants," subcontract number #A630-1341). Certain aspects herein may have been made in part during work supported by a Phase I Small Business Innovative Research contract from the United States Missile Defense Agency (HQ0006-06-C-7419) "Solid-State Electrically Controlled Rocket Motors for safe Attitude Control Systems." The government may have certain rights in the inventions disclosed herein.

Secrecy Order

The present application incorporates by reference U.S. patent application Ser. Nos. 11/305,742 and 10/136,786, which were previously under a secrecy order per 37 CFR 5.2.

BACKGROUND

1. Field of the Invention

This present invention is related to electrically controlled propellants, and in one exemplary embodiment to an improved electrically controlled propellant exhibiting improved performance and safety through resistance to ignition by electrical static discharge at ambient pressures. Methods for using the same are disclosed.

2. Description of the Related Art

There are numerous applications for gas-generating propellant compositions. Often in these applications it is desirable to control the ignition, burn rate, and extinguishment of a propellant by the application of an electrical current. Traditional uses of such gas-generating propellant compositions include rocket propulsion systems, fire suppression systems, oil field services, gas field services, mining, torpedoes, safety air bag systems, and other uses where quickly expanding gas is needed. In many of these instances, an electrically controlled propellant may allow the duration and burn rate of the propellant to be precisely controlled.

In some applications (particularly space and weapon systems), a smokeless or otherwise low signature propellant is desired, in which case a nitramine oxidizer is substituted for ammonium perchlorate. In other applications, high burn rate composites are required, in which case nitramines (RDX, HMX) in combination with nitroglycerin or nitrocellulose are used. These propellants are almost always class 1.1 explosives requiring added safety precautions in the production, shipping and storage of the propellants. In addition, high specific impulse (Isp) propellants are usually formed with ammonium perchlorate composites containing aluminum. These composites generate smoke both from the aluminum combustion and the hydrochloric acid generated interacting with moisture. Finally all of the current propellants have shown to be spark sensitive with many accidents occurring from a stray static charge causing ignition of the propellants during manufacturing (core pulling), storage (spark discharges of motor cases) and ignition and explosion in fires.

U.S. Pat. No. 5,734,124 to Bruenner, et al., describes the formation of liquid nitrate eutectic compositions for solid solution or emulsion propellants wherein inorganic nitrate oxidizers are combined in eutectic compositions that place the oxidizers in liquid form at ambient temperatures. These liquid combinations are then used in the preparation of a wide variety of energetic formulations, notably solution and emulsion propellants. The main component of these eutectic compositions is hydroxylamine nitrate. This same oxidizer is utilized in the propellants developed and described in this patent application. While many benefits of liquid propellants are disclosed in Bruenner, et al., no specific examples of solid solution or emulsion propellants are disclosed.

In contrast to conventional liquid propellants, conventional solid propellants combusted with electric power traditionally require high voltage (in the range of kilovolts) pulse discharges resulting in ablation of the propellant surface to produce ionizing gas species that is then accelerated by an electromagnetic field. Propellants such as these suffer from two serious drawbacks. First, conventional energetic solid propellants will not extinguish after the cessation of electrical current, thereby reducing the precision of control. Second, nonenergetic solid propellants provide none of their own thrust since the major portion of the thrust is generated by acceleration of the gas generation ions formed from the electrical energy source. In certain instances it would be beneficial to directly generate thrust from the gas generated by the chemical combustion of the propellant. To date neither a liquid, solid or gas phase propellant exists that can provide a dual purpose propulsion system providing chemical thrust for more rapid movement and threat avoidance combined with the potential for low thrust high specific impulse thrust.

U.S. Pat. No. 5,847,315 (Katzakian) demonstrates that a solid propellant developed as a gas generator for air bag inflators prepared with ammonium nitrate eutectic oxidizers and polyvinylamine nitrate polymer also performed as an electrically controllable extinguishable solid propellant (ECESP). This propellant is non-conductive, has a high electrical resistance and can only be readily ignited by the application of AC signals with either short electrical pathways or with a conductive coating applied to the bore surface of a large grain to reduce the power requirements for ignition. Rapid ignition was achieved only by applying both electrical current and high pressure to the composition.

Newer electrically controlled propellants have been developed and are described in U.S. patent application Ser. Nos. 10/136,786, 10/423,072, and 11/787,001 to Katzakian and others. The more recent '786, '072, and '001 applications disclose propellants demonstrating high conductivity, and are referred to as High Performance Electric Propellants ("HIPEP"). The electrically controlled propellant in the '786 and the '072 patent applications comprise an ionomeric oxidizer binder, an oxidizer mix including at least one oxidizer salt and at least one eutectic material that maintains the mix in a liquid form at the processing temperature and a mobile phase which may include at least one polar protic high boiling organic liquid.

The electrically controlled propellant disclosed in the '786 patent application has drawbacks of its own. Under certain circumstances the propellant can melt or soften during combustion, thereby decreasing its effectiveness and potentially undermining the ability of the propellant's use in situations where the propellant must be repeatedly ignited and extinguished. Additionally, the fluid phase has sufficient volatility to slowly evaporate from the surface of the propellant, making its application not suitable for use in the vacuum of space.

The '001 patent application discloses a still further improved propellant with the desirable characteristics that it be processable and curable at or near room temperature, that it have an electrical conductivity at its combustion surface that is significantly higher than that of the body of the propellant, and that it has a low energy threshold for ignition of the propellant and for maintaining of combustion, while still retaining extinguishment properties. In addition, it is highly electrically stable, conductive over a wide temperature range, and exhibits improved resistance to liquefaction during combustion. As a downside, sustained combustion at pressures less than 200 psi without the application of continuous electrical power input is not achievable using any of the '786, '072, and '001 references. Further, burn rates at pressures above 200 psi (at which the propellants would sustain combustion) is lower than conventional energetic composite solid propellants.

U.S. Pat. No. 5,837,931 to Bruenner et al. discloses a propellant that is liquid at room temperature, is useful as a liquid oxidizer, and that forms a solid solution or emulsion type solid propellant made of ammonium nitrate, hydrazinium nitrate, hydroxylammonium nitrate and/or lithium nitrate, including eutectics. These propellants, which contain a metal fuel, a hydrocarbon polymer and the liquid oxidizer, form a gel structure that supports the metal fuel. Bruenner et al. does not suggest liquid propellants that do not require the formation of solid solutions or eutectics.

U.S. Pat. No. 5,451,277 to Katzakian, et al., discloses a method of preparing a solid energetic composition of coated particles and liquid oxidizers. The energetic composition disclosed therein consists of aluminum powder particles coated with the polymer polyvinyl alcohol. Hydroxylammonium nitrate (HAN) is listed as a suitable liquid oxidizer. The particles disclosed therein are described to form porous solid grains for infusion with liquid oxidizer to thereby form a solid propellant grain, ignitable using conventional pyrotechnic igniters.

Extinguishment control and self-sustaining capabilities are described in a conventional double base or AP composite type propellant in U.S. Pat. No. 7,281,367 to Rohrbaugh et al. Here, extinguishment of a solid fuel grain is achieved by fully opening all valves in communication with the chamber pressure vessel resulting in rapid depressurization and extinguishment of the propellant. Reignition of the rocket motor is effected upon repressurization of the pressure vessel through closing at least some of the valves. In this application, multiple igniters are often necessary to either shorten reignition time or to effect reignition of the propellant.

The capability to sustain combustion at pressures lower than 200 psi without the input of electrical power is therefore important, and lacking in the art. Because many of the applications (particularly space vehicles) characteristically have a limited power supply, a highly efficient composition is also desirable.

SUMMARY OF THE INVENTION

A composition is disclosed capable of producing either solid propellant grains, liquid or gel monopropellants, all of which are electrically ignitable and capable of sustained controllable combustion at ambient pressure. Additional compositions capable of sustained controllable combustion at elevated pressures are also disclosed. Applications for the compositions disclosed herein are provided, and include among other applications use in small microthrusters, large core-burning solid propellant gains, shaped explosives charges for military application, and pumpable liquids and gel monopropellants or explosives for military, commercial mining or gas and oil recovery. Exemplary formulations of the above compositions are provided, demonstrating such traits as electric sustainable insensitive (HPPA), insensitive extinguishable non-toxic explosive (HPP) and flame sensitive explosive (HPB).

In an alternative embodiment the above compositions may also incorporate an energetic nitrate polymer, burn rate modifiers, and/or metal fuel(s). Each composition contains an energetic ionic liquid oxidizer or eutectic, and a fuel source consisting of a hydrocarbon liquid, monomer or polymer. These compositions can be formed into propellants or explosives in any manner currently recognized such as a monopropellant, gels, emulsions, sol-gels, thermoplastic or thermoset binders. The composition in form is electrically conductive and capable of ignition or enhanced combustion or detonation by the input of electrical power, yet is resistant to ignition by electrical static discharge (ESD) at ambient pressures. Ignition and sustained combustion is now possible at ambient and vacuum conditions (a) without continuous electrical power and (b) at burn rates faster than were conventionally available. Although combustion may be sustained in these conditions without the application of further electrical power, the addition of power causes an additional increase in the burn rate.

The use of electrical power to initiate a detonation may replace chemical sensitizing agents for explosives in some applications. Thus, for these applications no further chemical additives are required, which increases simplicity, decreases cost and often decreases toxicity associated with the composition and its use. For other applications, where the explosive container or location to be detonated can be pressurized from the natural environment or from an inert gas, the increased pressure alone serves as the sensitizing agent, once again increasing simplicity, decreasing cost and often decreasing toxicity.

The present application thus provides a family of propellants that while incorporating the base components of HIPEP and its safety features can now be tailored to different missions required for space weapons and explosives applications, while not compromising the safety and electrical control demonstrated by the HIPEP propellant. The ability to use certain fuels that were difficult to combust and burn in conventional solid propellants have demonstrated efficient combustion in the new compositions disclosed herein.

BRIEF DESCRIPTION OF THE FIGURES

The foregoing aspects and many of the attendant advantages of the invention will become more readily appreciated as the same becomes better understood by reference to the following detailed description, when taken in conjunction with the accompanying drawings, wherein.

DETAILED DESCRIPTION

The following description is presented to enable a person of ordinary skill in the art to make and use various aspects and examples of the present invention. Descriptions of specific materials, techniques, and applications are provided only as examples. Various modifications to the examples described herein will be readily apparent to those of ordinary skill in the art, and the general principles defined herein may be applied to other examples and applications without departing from the spirit and scope of the invention. Thus, the present invention is not intended to be limited to the examples described and shown, but is to be accorded the scope consistent with the appended claims.

An improved family of propellants and explosives is disclosed. In one example, the composition includes energetic materials that may be broadly described a electrically ignitable propellants (for example, as described in U.S. patent application Ser. Nos. 10/136,786, 10/423,072, 11/787,001, and 08/758,431 to Katzakian et al.) These electrically ignitable propellants can be ignited and controlled, at least in part, by the application of electrical power in an electrical circuit. That is, passing electrical current through the propellant causes ignition/combustion to occur, thereby obviating the need for pyrotechnic ignition of the propellant. Accordingly, in examples described herein, combustion of a specific volume of propellant (units of measurement of which may be described herein as a "grain" or "grain element" of propellant) is initiated and/or controlled by electrical power. Generally, electrical power from a direct current (DC) source is supplied, however, electrical power from an alternating current (AC) can be utilized as well.

Figure 1:
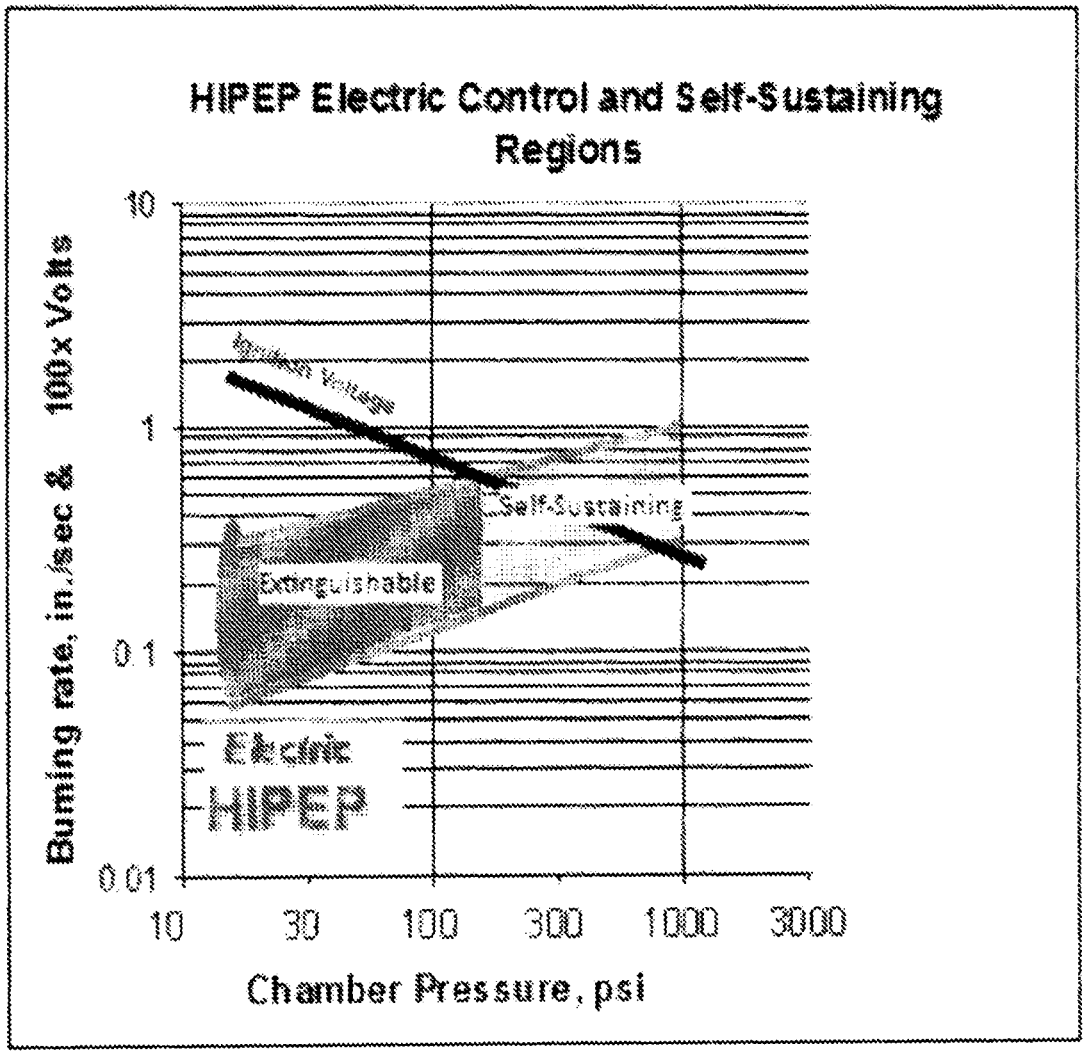
FIG. 1 depicts the relation of voltage and pressure to define extinguishable and self-sustaining regions of the improved HIPEP propellant.
Figure 2:
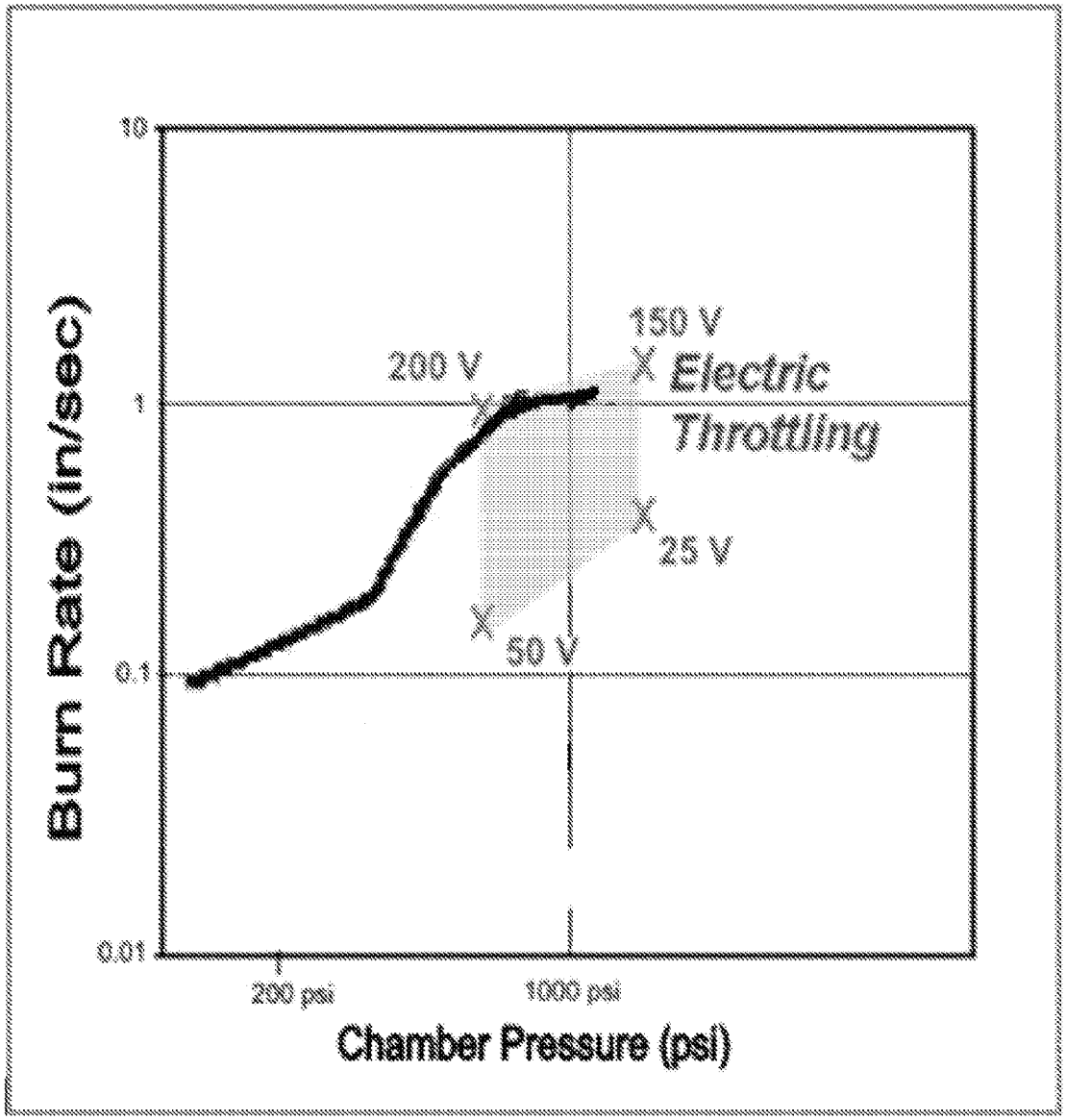
FIG. 2 shows the burn rate of the improved HIPEP propellant within the electric throttling region.

FIG. 1 shows the pressure and voltages for which the improved HIPEP propellant exhibits electric control (extinguishment) and self-sustaining capabilities. As seen in the figure, the highest power usage occurs during the ignition phase of the propellant at ambient pressures. Once the HIPEP propellant is burning, electric throttling is possible. Throttling may be used to avoid ignition delays and to reduce the power requirement since a delayed ignition using lower power could be utilized to ignite the propellant at ambient pressures and then pulse with higher power to increase the burn rate and generate increased thrust. The throttling range for HIPEP is at pressures above 300 PSI, as illustrated in FIG. 2.

Figure 4:
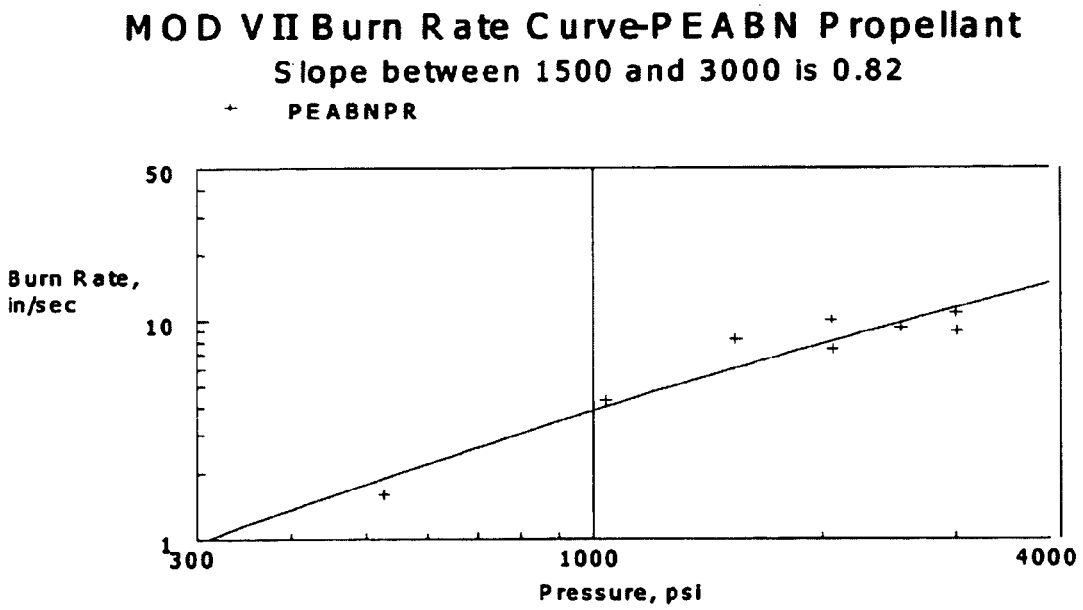
FIG. 4 shows the burn rate profile for propellants containing 50/50 mixture of PEABN/PVA with HAN oxidizer.

HPPA: Propellants containing HAN have limited compatibility with the conventional burn rate modifiers (e.g. lead oxide, ferric salts, nitrate esters and others) utilized in conventional solid propellants. However, propellants containing up to 50% of the polymer polyethanolaminobutyne nitrate (PEABN) in combination with PVA and HAN have been shown to produce propellants with extremely fast burning rates. See FIG. 4. A propellant containing a 50/50 blend of PEABN/PVA polymer and HAN has been shown to only sustain combustion at ambient pressure with the continuous input of electric power. In addition, the propellant is extremely soft on cure. The Applicant discloses an improved formulation containing both the Aluminum and the PEABN at a level shown in the composition below. This improved formulation exhibits sustained combustion at ambient pressure. This propellant formulation is referred to as HPPA, and is the second in the new family of high performance electrically ignitable solid propellants. A first exemplary composition demonstrating the improved properties of being flame insensitive, electrically ignitable and ambient pressure sustainable is described below in Table 1. The material "other" in Table 1 may comprise among other components polymer crosslinking agents, burn rate catalysts and aluminum metal chelate agents.

TABLE 1

| HPPA Embodiment 1 | |
|---|---|
| Material | Weight % |
| S-HAN 5 | 59.90 +/− 11% |
| PVA | 11.20 +/− 10% |

TABLE 1-continued

| HPPA Embodiment 1 | |
|---|---|
| Material | Weight % |
| PEABN | 2.80 +/− 10% |
| Aluminum Powder | 20.00 +/− 10% |
| Other | 6.10 +/− 10% |

Figure 5:
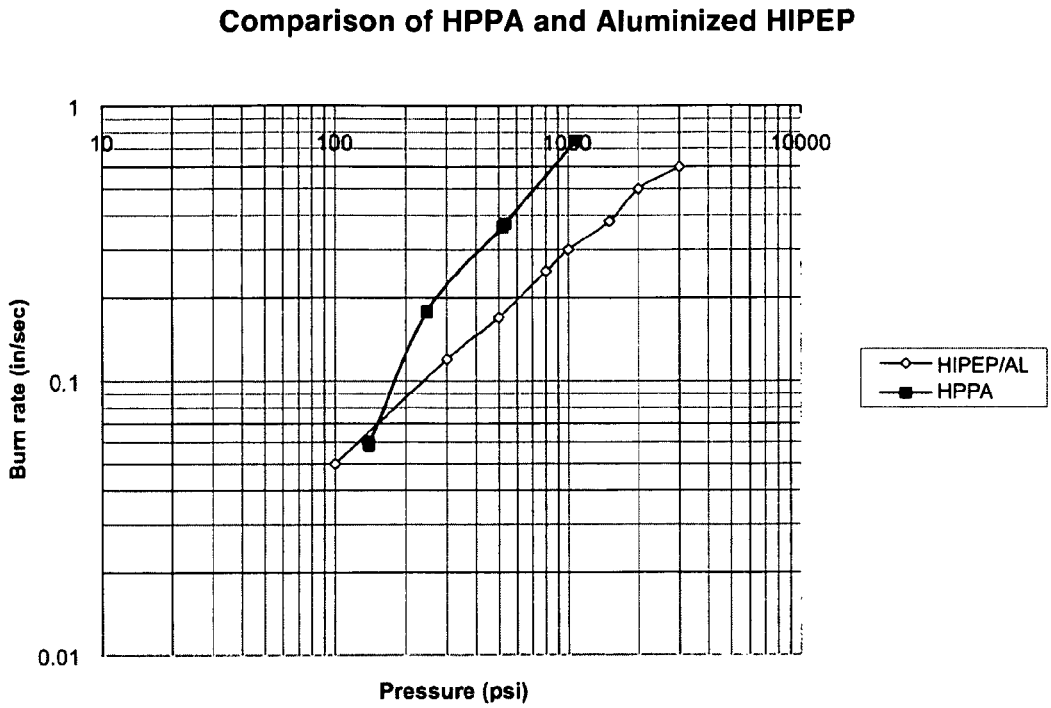
FIG. 5 is a burn rate comparison chart of HIPEP aluminized propellant and the applicant's HPPA aluminized propellant.

The above propellant is fast burning, produces no toxic exhaust gasses, is smokeless, and meets the new Insensitive Munitions Standards, that is, it is non-ignitable with a flame but ignitable with the application of electrical power. An improved burn rate over the standard HIPEP formulation is exhibited. At pressures less than 90 psi the formulation will not sustain combustion without electrical power. FIG. 5 depicts a comparison of the aluminized HIPEP burn rates (in inches per second) against the HPPA propellant described in Table 1 and the surrounding paragraphs.

A second exemplary HPPA composition is shown below in Table 2. The formulation provides adequate properties but the cured propellant is not as firm as desired for this application, therefore this composition is not preferred for use as an extinguishable solid propellant but may have application as an explosive.

TABLE 2

| HPPA embodiment 2 | |
|---|---|
| Material | Wt % |
| S-HAN-5* | 83.00 +/− 3% |
| PEABN | 3.00 +/− 10% |
| PVA | 12.00 +/− 10% |
| Crosslinker | 1.00 +/− 10% |
| ATZ | 1.00 +/− 10% |

Figure 3:
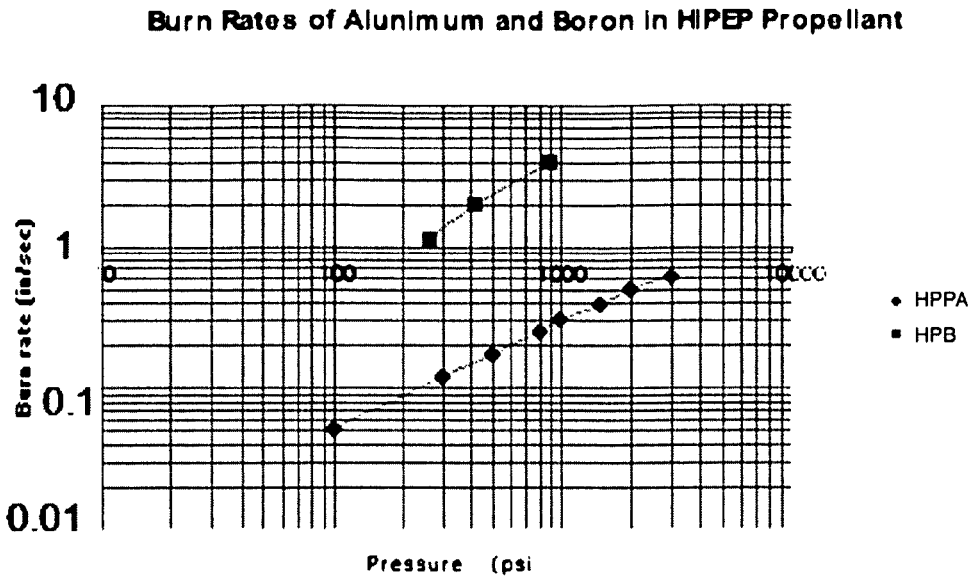
FIG. 3 shows the burn rates of two metalized (ESP) propellants, wherein the burn rate is higher for the boron metalized propellant.

HPB: A second improved HIPEP family member is HPB, in which in a preferred embodiment comprises nano-sized boron powder in place of aluminum powder. In this embodiment, the propellant is self-sustaining at ambient pressures and burns at high rates than that exhibited in the first exemplary embodiment of HPB. The composition is flame sensitive. See FIG. 3. The level of boron used ranges from 5-20% boron. The HPB boron based composition was unexpected because boron is not normally used in conventional solid propellants due to the inefficiency of its combustion and the fact that it burns at a lower temperature than aluminum. A typical formulation for a HPB propellant is shown below in Table 2.

TABLE 3

| HPB, Z | |
|---|---|
| Material | Weight % |
| S-HAN 5 | 65.00 +/− 15.00 |
| PVA | 14.00 +/− 1.00 |
| Boron | 20.00 +/− 18.00 |
| Other | 1.00 +/− 18.00 |

As above, the material "other" in Table 1 may comprise among other components polymer crosslinking agents, burn rate catalysts, stabilizers and other metal fuels. It may also include an additive to prevent the crystallization of the HAN oxidizer at room temperature, such as ammonium nitrate, hydrazine nitrate, alkyl amine nitrate, other nitrate salts, water, alcohol, and any other additive proven to be compatible with HAN.

Returning to FIG. 3, the fast burn rates of the Boron propellants relative to their aluminized counterparts allows the propellant to be utilized to form safe explosives in which a lower level charge could be applied to the material either prior to or right at the initiation of a detonation charge, thereby causing supersonic combustion and a large pulse detonation of the propellant.

HPP: A third member of the new family of high performance electrically ignitable propellants, and incorporating chromium amino tetrazolate (CrATZ) is disclosed in Table 4.

TABLE 4

| HPP | |
|---|---|
| Material | Wt % |
| S-HAN-5 | 82.25 +/− 3% |
| ATZ | 1.00 +/− 10% |
| PEABN | 2.75 +/− 10% |
| PVA | 11.00 +/− 10% |
| Crosslinker | 1.00 +/− 10% |
| CrATZ | 2.00 +/− 10% |

Figure 6:
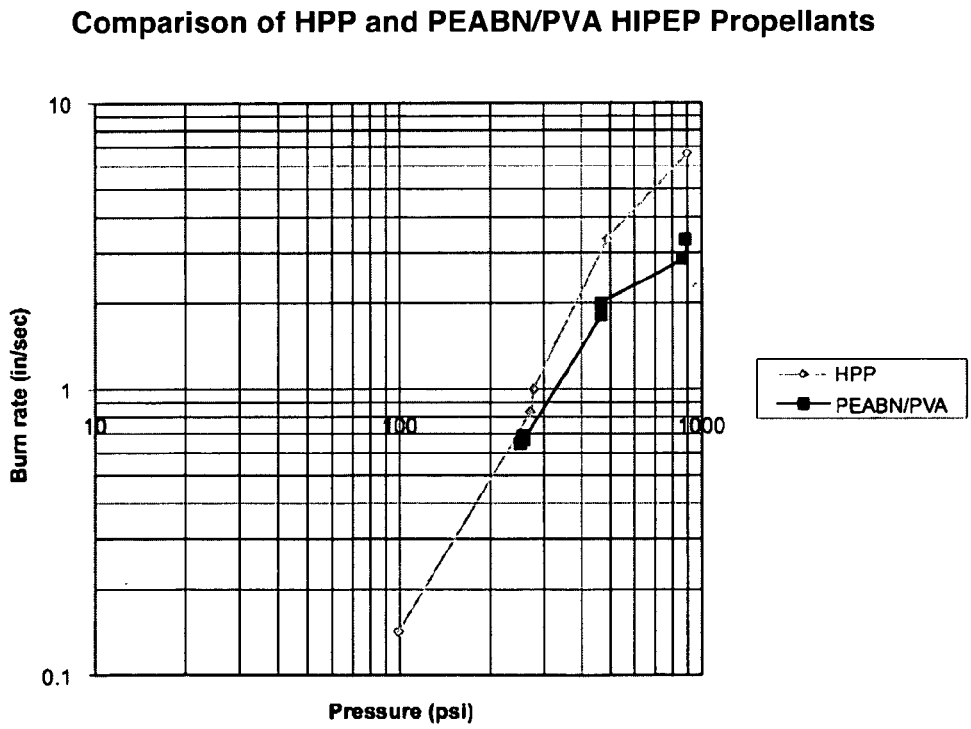
FIG. 6 shows comparison burn rates of PEABN/PVA HIPEP and HPB propellants.

Here, the CrATZ has a significant influence on the burn rate at higher pressures, as shown in FIG. 6. This composition is also non-ignitable with a flame but ignitable with the application of electrical power, and therefore would also meet the new Insensitive Munitions Standards. Additionally, both formulations will not sustain combustion without electrical power at pressures less than 90 psi.

As solids this formulations require the use of PVA molecular weight of 146,000-186,000 co-polymers of PVA/PVAN reacted with epoxide to increase the MW from 96,00-142,000 to over ~300,000, the use of a chemical cross linking agent. Liquids would be formed use low molecular weight PVA polymer of MW between 2,000 and 100,000.

Figure 8:
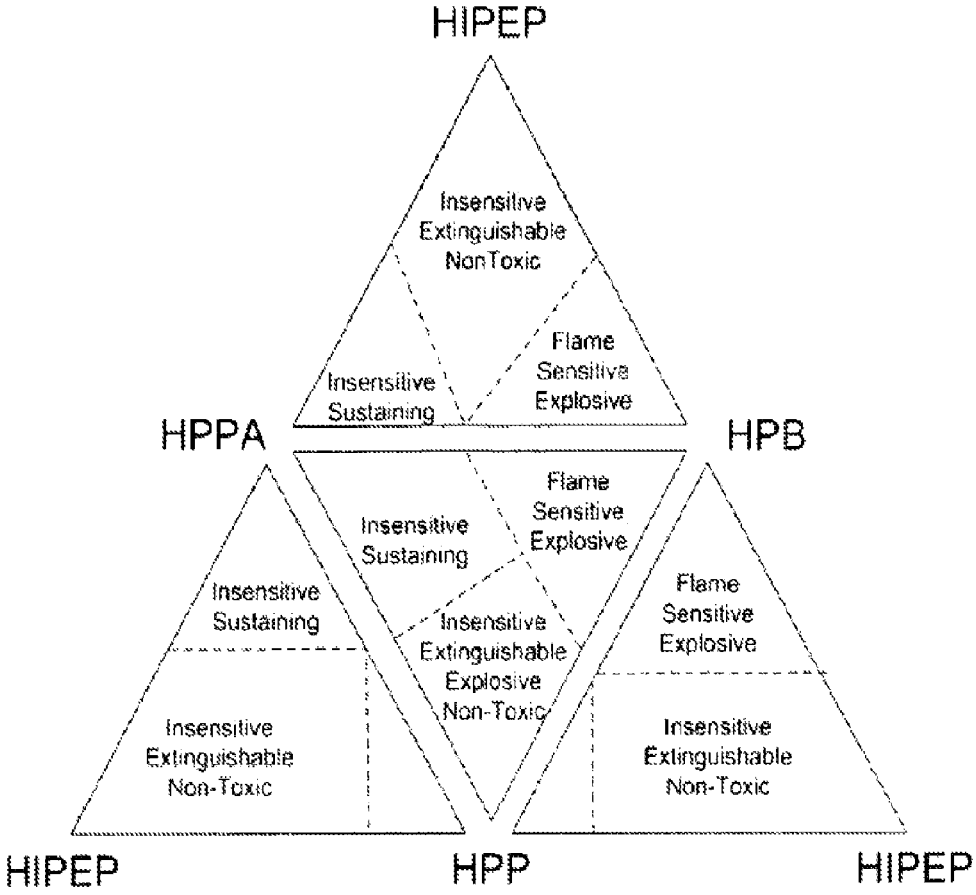
FIG. 8 is a ternary diagram describing general properties of various end-member mixtures.

Taking the above compositions together, the Applicant has thus discovered a new family of HIPEP, with its members as described in the above exemplary formulations being specifically tailored based on application requirements. FIG. 8 depicts the various general properties of the various end-member mixtures. Transitional boundaries between properties and characteristics associated with each family member are shown as dashed lines. Metal composites can be used to bridge end members. For instance, as an example the use of Al or Al coated Zr and Ti bridges the properties between HIPEP and the HPPA family, whereas Boron or Al coated Boron or Al coated Tungsten bridges the properties between HIPEP an the HPB family. Example applications and the composition best suited for it are described below.

For applications where extinguishment of the propellant is not required but fast burn rates or reactions are required such as shape charge, explosive or continuous on demand gas generation, the substitution of Boron metal powder in formulation HPPA (Table 2) would best be suited Also below, a liquid alternative embodiment to the above solid compositions is described that utilizes a low molecular weight polymer of PVA (31,000-50,000) with Boron Powder to form an electrically ignitable liquid monopropellant or explosive. Other exemplary alternative liquid monopropellants combine HAN with new energetic fuels such as dihydrazino butyne dinitrate and Polyethanolaminobutyne nitrate. Alternatively low molecular polyvinylamine nitrate (MW 50,000-100,000) could be used to make a liquid monopropellant. When the co-polymer of polyvinyl alcohol and polyvinyl amine is reacted with epoxy and then nitrated the resulting nitrated co-polymer forms a pumpable gel with S-HAN-5. Finally the S-HAN-5 may in an additional exemplary embodiment be combined with Otto-fuel and an emulsifying agent for water oil and combined with seawater was prepared as a combustible fuel for torpedoes. This material is a much safer replacement for the traditional use of Hydroxylamine perchlorate and Otto-Fuel.

Turning now to the applications for each of the family members, a first application is in a DACS (Divert Attitude and Control Subsystem) system, wherein requirements typically call for small thrust levels to be applied over a long duration in order to de-spin a launched projectile in the exo-atmosphere, all while maintaining the capability to later apply high thrust levels in order to redirect the projective for reentry. Generally in such projectiles, available power supply is quite limited, and in one exemplary case is limited to <100 W. Furthermore, such projectiles are generally traveling at high mach speeds (5-7) and are spinning at such a high frequency that small pulse thrusts to de-spin the projectile do not impart enough force to be successful. The propellants discussed in this patent application being highly conductive have demonstrated that they can be ignited at lower power levels at ambient pressures. The HPPA composition shown above in Table 1 being a sustainable electrically ignited propellant for applications where extinguishment is not necessary, would be the best family member for this application. The HPB composition would also meet the DACS requirements if the flame sensitivity can be tolerated in the design. As compared to the standard HIPEP composition disclosed in a previous application, requirements in that case include both voltage and high-pressure chambers to sustain propellant combustion. Thus, the standard HIPEP formulation would not be applicable for a DACS implementation requiring despin of a high mach and high spin projectile.

Figure 7:
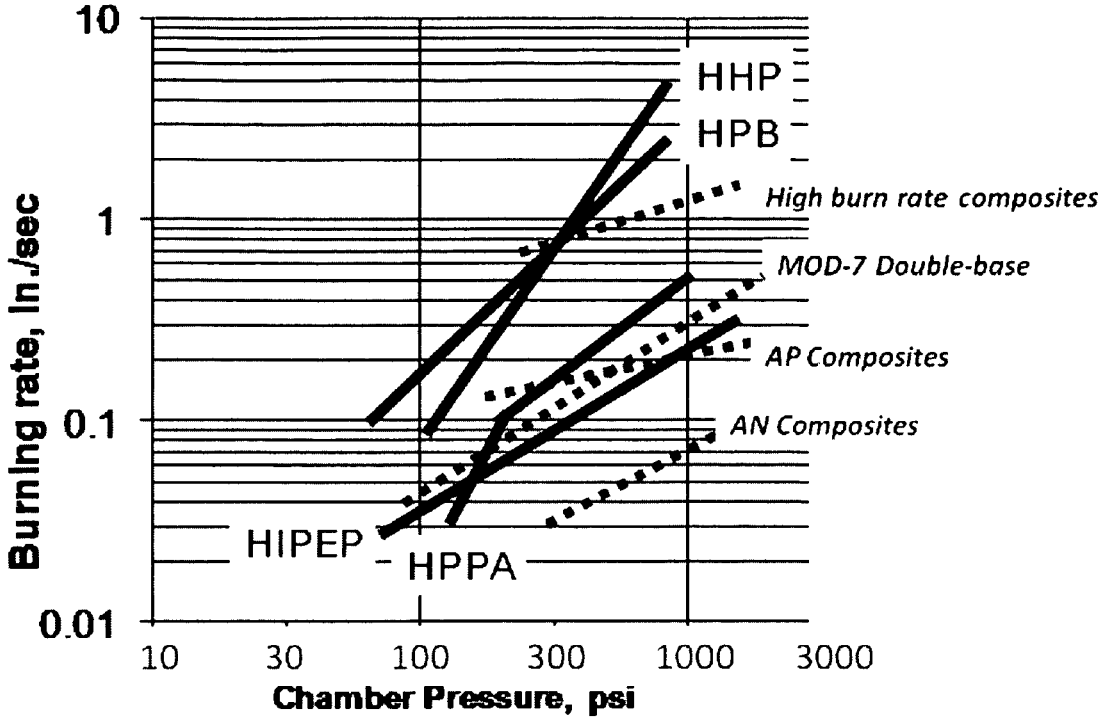
FIG. 7 is a comparison chart depicting the burn rate of the applicant's new safe electric propellants vs. current conventional propellants, (data partially obtained from Rocket Propulsion Elements, by Sutton and Biblarz (2001))

In longer space flights where requirements include lower power consumption as well as occasional high thrust output to adjust position or orbit, HPP may be utilized. HPP is also effective for use in tactical missile or weapon applications when a clean, smokeless, munitions insensitive propellant system must be utilized to provide a fast burn rate supportive of the launch of a warhead or armament from a cannon or medium or small caliber weapon. The faster burn rates exhibited by the HPP translates into higher thrust levels, thus providing increased range or impact energy for the warhead when fired from the weapon at comparable chamber pressures. The ability to attain high burn rates at lower chamber pressures provides a savings in the manufacture of the overall system due to lower material operating pressure requirements, reduced weight and enhanced safety. FIG. 7 shows how HIPEP as well as the improved HIPEP formulations compare with current conventional propellant systems containing double base, AP composites, AN composites and high burn rate composites. Clearly, HPP provides the fastest burn rates at high pressure.

In certain instances in space flights it is beneficial to directly generate thrust from the gas generated by the chemical combustion of the propellant. Such a short but high thrust may be needed to rapidly move a satellite position to avoid collision with space debris or purposeful interception and destruction from a missile warhead or interceptor. The dual-purpose propellant disclosed provides the potential for chemical thrust for more rapid movement and threat avoidance along with low thrust high specific impulse applications. These low thrust high specific impulse applications generates small quantities of ionizable gas compositions containing high mass elements that are ionized and accelerated by an applied electromagnetic force, thereby providing for long-term sustainable positioning and placement. Heavy metals that may be ionized include but are not limited to gold, platinum, tungsten and zirconium. The composition in this application may also contain glass phase metals such as glassy boron, tungsten, molybdenum and zirconium. The heavy metals cited above also are utilized in explosive warheads and devices to increase the density and detonation shock wave of explosives.

Another exemplary application for the new family of HIPEP is in shaped charges or in bulk explosives comprising mainly ammonium nitrate with fuel oil, generally known by the term ANFO. The new family disclosed herein is a suitable replacement for ANFO. In all cases increased performance of such explosives is conventionally accomplished through the use of sensitizing agents such as nitroglycerin, nitramines, ethylene glycol dinitrate, TNT in combination with fine aluminum powder or magnesium, and the like. Conventionally, detonation is initiated with either a detonation cord, blasting cap or other explosive charge. The compositions disclosed in the present application have demonstrated burn rates greater than 10 inches/second. Furthermore, the ability to store electrical charge in the propellant and then initiate it with a pressure force that creates supersonic combustion would allow explosives based on the current formulation to be replaced for those that need a chemical sensitizer. Here, the sensitizer in the present application is simple a combination of inert gas and electrical charge, thereby providing a safer and less toxic alternative to other explosives. An applicable family member for this application would be either HPP or HPB in solid form. As liquids for the HPP family would entail use of the PEABN polymer alone and for the HPB liquid low molecular weight PVA, PEABN or emulsified with a hydrocarbon fuel could be used to make an electrically controlled yield explosive.

Figure 9:
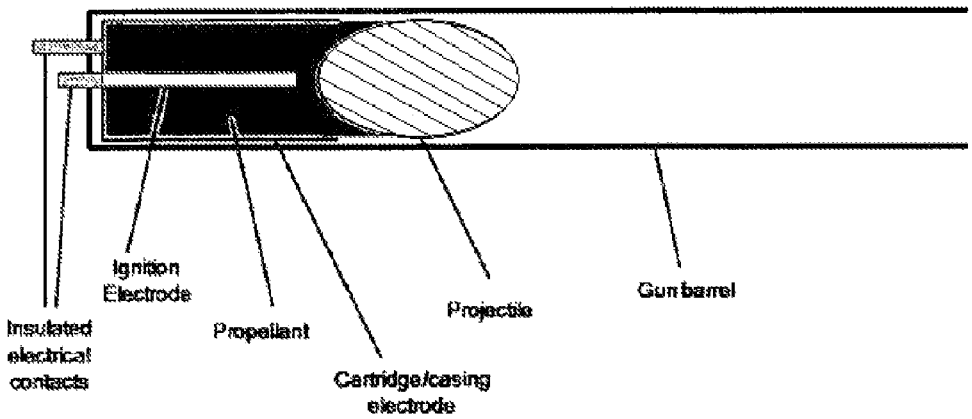
FIG. 9 is an illustration of an electrothermal-chemical gun for which this family of propellants could be utilized with as a propellant.

Another exemplary application of the structures and methods described herein includes an electronic projectile or gun apparatus. For instance, FIG. 9 illustrates an exemplary structure 1300 for an electrically ignitable projectile or gun. As illustrated, a volume of electrically ignitable propellant is suitable connected to electrodes and disposed within the structure to propel a projectile when ignited, e.g., the combustion of the propellant propelling the projectile from the barrel. The conductive nature of the each member of this family of propellants allows them to be utilized as a propellant for such a gun apparatus.

In addition to the above compositions and application, developments in improved electrode geometries for detonation has been developed as well. The applicant has developed and has filed patent applications on the development of improved electrode geometries that made it possible to ignite HIPEP propellant at relatively low power DC both in atmospheric and vacuum environments. In the sustainable propellant formulation, electrode pairs in the form of short wires at one or both ends of grain have been developed. For larger end-burner or core burning grains, multiple positive electrodes embedded into the propellant with a single ground source has replaced the need for multiple electrode pairs.

Additional applications for the new HIPEP family members become available when the members are in liquid form. There are three methods to create liquid pumpable members of the family of propellants. The first is through the use of low molecular weight polymer and the non-use of a crosslinking additive. The second is through reacting the co-polymer (such as polyvinyl alcohol or polyvinylamine nitrate) with epoxy to create a highly crosslinked polymer that does not allow the HAN to swell into the polymer. Alternatively, a co-polymer such as PVA/Polyethylene would not dissolve in the HAN solution and would remain a slurry. Finally, an emulsion solution using an emulsion agent, HAN as the oxidizer, and polybutadiene as the fuel. When in liquid form other applications become available.

For instance, the ability to enhance oil or gas recovery utilizing a liquid propellant has been taught in U.S. Pat. No. 6,098,516 to Gazonas, which incorporates the use of a liquid gun propellant. The liquid propellant enhances the oil recovery by the increasing the hydraulic fracture treatment through combustion of the propellant creating working pressure to propagate fractures and to create heat to reduce the viscosity of the entrapped oil. The new family of propellants described in the present application provide for superior performance and the enhancement capability of combing increased yield explosives resulting from the application of pressure and electrical power. Additionally, the composition disclosed herein will yield higher temperature and gas generation. Finally, the demonstrated ability to control the combustion process of this family of propellants through the input of electrical power in combination with pressure results in a more tailorable explosive to match the rock or subsurface composition. Proppants, essentially inert with regard to the compositions disclosed herein, can be mixed with them further hold fractures open after explosive treatment. Formulated here, HPB, HPP and HPPA would remain a slurry in this use while the original HIPEP composition would remain a complete liquid monopropellant.

As a specific example for how a propellant explosive would be made either as a solid, gel, emulsion, or liquid, the HPPA propellant composition will be detailed here, although it should be readily apparent to one skilled in the art. The HPPA formulation incorporates the addition of both aluminum and the polymer polyethanolaminobutyne nitrate to produce a gas generating composition that while flame insensitive will ignite and sustain at ambient conditions once ignited with electric power. The difference in form between a solid, liquid, gel or emulsion relates to the use of the polymer and its properties. For example solids (sol-gel) are formed using PVA polymer of molecular weight greater than 146,000, where as liquids would utilize low molecular weight PVA polymer (30-50,000), gels would utilize higher molecular weight PVA polymers that swell but do not dissolve forming a gel and emulsion would utilize a hydrocarbon monomer such as polybutadiene or epoxy that would use an emulsifying agent to incorporate the liquid oxidizer inside the hydrocarbon phase as micelles. A typical procedure for the preparation of 100 grams of material is as follows.

Weigh into a glass/stainless steel or aluminum container 59.90 grams of S-HAN oxidizer and liquid additives. The other solids ingredients (6.1 grams) except for the polymer and metalized fuel are added and stirred till dissolved. The metal fuel (20.0 grams) is added and stirred under vacuum for one hour at 23-25° C. In the final step the polymer (14.0 grams) is added and stirred until either is dissolved in the case of the liquid and gel-sol or till gelled. The pot-life of the mix being controlled by heat treating the PVA and regulating the mix temperature to ≤25° C. Normally preparation of a liquid, gel or sol-gel product is done utilizing a low shear propeller type mixer. The formation of an emulsion is done utilizing a high speed mixer or sonicator. Grains of the liquid and gel-sol are cast under vacuum and with pressure for the emulsions and gels. To ignite the explosives in this case the composition is flowed across an electrode for ignition or detonation cord is placed into the liquid propellant for broad ignition along its entire length As described above, the presently disclosed electric propellants can be formulated and processed to meet the various space and weapon needs with the addition of a few components to meet the mission needs. All the propellants have demonstrated superior safety features in terms of electrical static discharge and fire situations. These propellants are expected to be DOD/DOT class 1.3 explosives. These propellants are classified as "green propellants" in manufacturing, use and disposal. They are processed under much milder conditions not requiring grinding or blending, high shear mixers and elevated processing and cure temperatures. In addition, the ability to ignite and control the combustion through the use of electrical power alone or with pressurization makes them safer than current systems. Finally, the compositions disclosed herein offer improved performance and enhanced safety over conventional double base or composite propellants utilizing ammonium perchlorate, nitrocellulose/nitroglycerin, nitramines or ammonium nitrate.

With respect to the above description then, it is to be realized that material disclosed in the applicant's drawings and description may be modified in certain ways while still producing the same result claimed by the applicant. Such variations are deemed readily apparent and obvious to one skilled in the art, and all equivalent relationships to those illustrated in the drawings and equations and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact disclosure shown and described, and accordingly, all suitable modifications and equivalents may be resorted to, falling within the scope of the invention.

We claim:

1. An electrically ignitable gas generating composition comprising:

a. at least one alkyl polymer selected from the group consisting of polyvinyl alcohol, polyvinylamine nitrate, polyvinyl alcohol co-polymer polyvinylamine nitrate, and polyethylenimine nitrate;

b. an oxidizer mixture selected from the group consisting of:

i. concentrated hydroxylamine nitrate (HAN); and ii. a eutectic oxidizer mix comprising ammonium nitrate;

c. a fuel additive; and d. wherein at ambient pressure said composition is electrically ignitable, sustains combustion and burns at a first rate and at elevated pressure said composition is ignitable with a flame source and burns at a second rate higher than said first rate.

2. The composition according to claim 1 further comprising a first additive to prevent crystallization of HAN.

3. The composition according to claim 1 further comprising at least one mass enhancing non-fuel metal selected from the group consisting of gold, platinum, tungsten and zirconium, wherein said mass enhancing non-fuel metal is in a form selected from the group consisting of nano-particles, foils, coatings or depositions.

4. The composition according to claim 1 wherein said alkyl amine nitrate is selected from the group consisting of ethanolamine nitrate, ethylamine nitrate, and methylamine nitrate.

5. The composition according to claim 1 further comprising either a metalized fuel selected form the group consisting of aluminum, boron, tungsten, zirconium or a glass phase metal selected from the group of glassy boron, tungsten, molybdenum and zirconium.

6. The composition according to claim 5 further comprising nano-particles selected from the group consisting of boron, magnesium, aluminum coated tungsten and aluminum coated zirconium.

7. The composition according to claim 1 further comprising a combustion modifier additive.

8. The composition according to claim 7, wherein said combustion modifier additive comprises at least 5-aminotetrazole complex metal, and wherein said metal is selected from the group consisting of nickel (II), chromium (III), and iron (III).

9. The composition according to claim 8, wherein said combustion modifier additive comprises an energetic nitrate polymer.

10. The composition according to claim 9, wherein said energetic nitrate polymer is polyethanolaminobutyne nitrate.

11. An electrically ignitable gas generating composition comprising:

a. a polyalkyl binder;

b. an oxidizer mixture comprising hydroxylamine nitrate (HAN) and a first additive that inhibits crystallization of concentrate hydroxylamine solutions;

c. a metalized fuel component;

d. a mass enhancing non-fuel metal selected from the group consisting of gold, platinum, tungsten and zirconium wherein said mass enhancing non-fuel metal is in a form selected from the group consisting of nano-particles, foils, coatings or depositions, and e. wherein said composition is electrically ignitable at ambient pressures.

12. The electrically ignitable solid gas generating composition according to claim 11 further comprising a glass phase metal selected from the group consisting of glassy boron, tungsten, molybdenum and zirconium.

13. The electrically ignitable gas generating composition according to claim 11 wherein said polyalkyl binder is a nitrate based oxidizer.

14. The electrically ignitable gas generating composition according to claim 11 wherein said polyalkyl binder is selected from the group consisting of polyvinyl alcohol, polyethylenimine nitrate, polyvinyl alcohol co-polymer polyvinylamine nitrate, and polyethanolaminobutyne nitrate.

15. An electrically ignitable gas generating composition comprising:

a. an alkyl polymer selected from the group consisting of polyvinyl alcohol and polyvinyl alcohol co-polymer polyvinylamine nitrate;

b. an oxidizer mixture comprising concentrated hydroxylamine nitrate (HAN) and a first additive that prevents crystallization of the HAN oxidizer at room temperature;

c. a metalized fuel component, and d. wherein said composition is electrically ignitable at ambient pressures.

16. The composition according to claim 15, wherein said first additive is selected from the group consisting of ammonium nitrate, hydrazine nitrate and an alkyl amine nitrate.

17. The composition according to claim 16 wherein said alkyl amine nitrate is selected from the group consisting of ethanolamine nitrate, ethylamine nitrate, and methylamine nitrate.

18. The composition according to claim 15 further comprising a glass phase metal.

19. The composition according to claim 18 wherein said metalized fuel is selected from the group consisting of aluminum, boron, tungsten, zirconium and wherein said glass phase metal is selected from the group consisting of glassy boron, tungsten, molybdenum and zirconium.

20. The composition according to claim 18 further comprising nanoparticles selected from the group consisting of boron, aluminum coated boron, aluminum coated magnesium, and aluminum coated tungsten.

21. The composition according to claim 20, wherein said oxidizer mixture comprises hydroxylamine nitrate and ammonium nitrate.

22. The composition according to claim 21, wherein said oxidizer mixture comprises hydroxylamine nitrate, ammonium nitrate and hydrazine nitrate.

23. The composition according to claim 21, wherein said oxidizer mixture comprises hydroxylamine nitrate, ammonium nitrate and ethanolamine nitrate.

24. The composition according to claim 15, further comprising a combustion modifier additive.

25. The composition according to claim 24, wherein said combustion modifier additive comprises an energetic nitrate polymer.

26. The composition according to claim 25, wherein said energetic nitrate polymer is polyethanolaminobutyne nitrate.

27. The composition according to claim 24, wherein said combustion modifier additive comprises at least one 5-aminotetrazole complex of a metal, and wherein said metal is selected from the group consisting of chromium (III), and iron (III).

28. An electrically ignitable gas generating composition comprising:

a. a polyalkyl binder comprising polyvinyl alcohol or polyvinyl alcohol co-polymer polyvinylamine nitrate;

b. an oxidizer mixture comprising hydroxylamine nitrate and a first additive that inhibits crystallization of concentrate hydroxylamine solutions;

c. a metalized fuel component, and d. wherein said composition is electrically ignitable at ambient pressures.

29. The composition according to claim 28 further comprising at least one mass enhancing non-fuel metal selected from the group consisting of gold, platinum, tungsten and zirconium, wherein said mass enhancing non-fuel metal is in a form selected group consisting of nano-particles, foils, coatings and depositions.

30. An electrically ignitable gas generating composition comprising:

a. an alkyl polymer selected from the group consisting of polyvinyl alcohol and polyvinyl alcohol co-polymer polyvinylamine nitrate;

b. an oxidizer composition comprising concentrated hydroxylamine nitrate (HAN) and a first additive that prevents crystallization of the HAN oxidizer at room temperature;

c. a metalized fuel component, wherein said fuel component is selected from the group consisting of boron, aluminum, aluminum coated zirconium, and tungsten, and d. wherein said composition is electrically ignitable at ambient pressures.

31. The composition of claim 28 wherein said boron and aluminum are nano-sized.

32. A composition according to claim 31, further comprising a combustion modifier additive.

33. The composition according to claim 31, wherein said combustion modifier additive comprises at least one 5-aminotetrazole complex of metal, wherein said metal is selected from the group consisting of chromium (III), and iron (III).

34. The composition according to claim 29 wherein said first additive is selected from a group consisting of ammonium nitrate, hydrazine nitrate and an alkyl amine nitrate.

35. The composition according to claim 34 wherein said alkyl amine nitrate is selected from the group consisting of ethanolamine nitrate, ethylamine nitrate, and methylamine nitrate.

36. The composition according to claim 29, wherein the composition contains metalized fuel selected from the group consisting of aluminum, boron, tungsten, and zirconium.

37. The composition according to claim 36 wherein said aluminum and boron are nano-sized and wherein said tungsten and zirconium are coated with aluminum.

38. The composition according to claim 37, wherein said oxidizer mixture comprises hydroxylamine nitrate and ammonium nitrate.

39. The composition according to claim 38, wherein said oxidizer mixture comprises hydroxylamine nitrate, ammonium nitrate and hydrazine nitrate.

40. The composition according to claim 38, wherein said oxidizer mixture comprises hydroxylamine nitrate, ammonium nitrate and ethanolamine nitrate.

41. An electrically ignitable solid gas generating composition comprising:

a. a polyalkyl binder selected from the group consisting of polyvinyl alcohol and polyvinyl alcohol co-polymer polyvinylamine nitrate;

b. an oxidizer mixture comprising hydroxylamine nitrate and a first additive that inhibits crystallization of concentrate hydroxylamine solutions;

c. a metalized fuel component, and d. wherein said composition is electrically ignitable at ambient pressures.

42. The composition according to claim 41 further comprising at least one mass enhancing non-fuel metal selected from the group consisting of gold, platinum, tungsten and zirconium, wherein said mass enhancing non-fuel metal is in a form selected group consisting of nano-particles, foils, coatings and depositions.

43. The electrically ignitable solid gas generating composition according to claim 41 further comprising a glass phase metals selected from the group of glassy boron, tungsten, molybdenum and zirconium.

44. The composition according to claim 1 further comprising a first additive to prevent crystallization of HAN at room temperature.

45. The composition according to claim 28 wherein:

a. said first additive inhibits crystallization of concentrate hydroxylamine solutions at room temperature.

46. The composition according to claim 1 wherein said composition is one of a liquid and a gel.

47. The composition according to claim 11 wherein said composition is one of a liquid and a gel.

48. The composition according to claim 28 wherein said composition is one of a liquid and a gel.

* * * * *

UNITED STATES PATENT AND TRADEMARK OFFICE

CERTIFICATE OF CORRECTION

PATENT NO. : 8,888,935 B2
APPLICATION NO. : 12/993084
DATED : November 18, 2014
INVENTOR(S) : Grix et al.

It is certified that error appears in the above-identified patent and that said Letters Patent is hereby corrected as shown below:

In the Claims

Claim 31, column 14, line 60, 28 should be 30.

Signed and Sealed this
Fourteenth Day of July, 2015

Michelle K. Lee

Michelle K. Lee
*Director of the United States Patent and Trademark Office*